US008402721B2

(12) United States Patent
Krämer et al.

(10) Patent No.: US 8,402,721 B2
(45) Date of Patent: Mar. 26, 2013

(54) BEVERAGE BOTTLING OR CONTAINER FILLING PLANT HAVING A BEVERAGE BOTTLE OR CONTAINER LABELING MACHINE, AND A BEVERAGE BOTTLE OR CONTAINER LABELING MACHINE

(75) Inventors: Klaus Krämer, Dortmund (DE); Lutz Deckert, Haltern am See (DE); Oliver Kress, Waltrop (DE)

(73) Assignee: KHS GmbH, Dortmund (DE)

( * ) Notice: Subject to any disclaimer, the term of this patent is extended or adjusted under 35 U.S.C. 154(b) by 333 days.

(21) Appl. No.: 12/429,267

(22) Filed: Apr. 24, 2009

(65) Prior Publication Data

US 2010/0101681 A1 Apr. 29, 2010

Related U.S. Application Data

(63) Continuation-in-part of application No. PCT/EP2007/009215, filed on Oct. 24, 2007.

(30) Foreign Application Priority Data

Oct. 27, 2006 (DE) ..... 10 2006 051 360

(51) Int. Cl.
*B65B 61/00* (2006.01)

(52) U.S. Cl. ..... 53/136.1; 53/135.1; 118/261

(58) Field of Classification Search ..... 53/135.1, 53/136.1; 118/261; 141/98, 129
See application file for complete search history.

(56) References Cited

U.S. PATENT DOCUMENTS

| | | | | |
|---|---|---|---|---|
| 2,946,307 A | | 7/1960 | Warner | |
| 2,970,564 A | * | 2/1961 | Warner | 118/249 |
| 3,294,060 A | * | 12/1966 | McIntyre et al. | 118/261 |
| 3,361,059 A | * | 1/1968 | Klingler | 101/169 |
| 3,659,553 A | | 5/1972 | Tobias | |
| 3,735,733 A | | 5/1973 | Henc | |
| 3,762,365 A | * | 10/1973 | Herzog | 118/212 |
| 3,780,670 A | * | 12/1973 | Abler et al. | 101/363 |
| 3,795,221 A | | 3/1974 | Michael | |
| 3,991,708 A | * | 11/1976 | Huebschmann et al. | 118/44 |
| 4,009,657 A | * | 3/1977 | Bonanno et al. | 101/157 |
| 4,347,095 A | * | 8/1982 | Yamashita | 156/578 |
| 4,357,370 A | * | 11/1982 | Alheid | 427/211 |

(Continued)

FOREIGN PATENT DOCUMENTS

| | | |
|---|---|---|
| DE | 145 620 | 12/1980 |
| DE | 44 44 779 | 6/1996 |

(Continued)

OTHER PUBLICATIONS

International Search Report PCT/EP2007/009215 and English translation thereof.

(Continued)

*Primary Examiner* — Thanh Truong

(74) *Attorney, Agent, or Firm* — Nils H. Ljungman & Associates

(57) ABSTRACT

A container labeling machine gluing apparatus which has a rotatable glue roller and a glue dispenser for dispensing glue onto the glue roller. The apparatus also has a glue thickness adjuster which adjusts the thickness of a glue layer on the glue roller. The glue thickness adjuster comprises a spring element and a glue contact element connected to the spring element, which spring element presses the glue contact element into contact with glue on the glue roller. The glue contact element is disposed upstream of remaining portions of its glue thickness adjuster in the direction of rotation of the glue roller.

20 Claims, 7 Drawing Sheets

U.S. PATENT DOCUMENTS

| | | | | | |
|---|---|---|---|---|---|
| 4,685,417 | A | * | 8/1987 | Kronseder | 118/261 |
| 4,848,268 | A | | 7/1989 | Sollinger et al. | |
| 4,889,071 | A | * | 12/1989 | Fundell | 118/126 |
| 5,121,689 | A | * | 6/1992 | Fadner | 101/365 |
| 5,226,364 | A | * | 7/1993 | Fadner | 101/366 |
| 6,360,660 | B1 | * | 3/2002 | Allison, Jr. | 101/169 |
| 6,439,290 | B1 | * | 8/2002 | Monti | 156/578 |

FOREIGN PATENT DOCUMENTS

| | | |
|---|---|---|
| DE | 202 20 132 | 4/2004 |
| EP | 0 311 728 | 4/1989 |
| EP | 0 571 849 | 12/1993 |
| JP | 6134386 | 5/1994 |
| JP | 6202517 | 7/1994 |
| JP | 8323259 | 12/1996 |
| WO | WO 97/38797 | 10/1997 |

OTHER PUBLICATIONS

International Preliminary Report on Patentability PCT/EP2007/009215 and English translation thereof.

* cited by examiner

BEVERAGE BOTTLING OR CONTAINER FILLING PLANT HAVING A BEVERAGE BOTTLE OR CONTAINER LABELING MACHINE, AND A BEVERAGE BOTTLE OR CONTAINER LABELING MACHINE

CONTINUING APPLICATION DATA

This application is a Continuation-In-Part application of International Patent Application No. PCT/EP2007/009215, filed on Oct. 24, 2007, which claims priority from Federal Republic of Germany Patent Application No. 10 2006 051 360.6, filed on Oct. 27, 2006. International Patent Application No. PCT/EP2007/009215 was pending as of the filing date of this application. The United States was an elected state in International Patent Application No. PCT/EP2007/009215.

BACKGROUND

1. Technical Field

The present application relates to a beverage bottling or container filling plant having a beverage bottle or container labeling machine, and a beverage bottle or container labeling machine. The present application further relates to rotary labeling machines for applying labels to bottles or containers. The present application relates to a gluing apparatus with at least one glue roller which can be driven so that it rotates around its roller axis. The gluing apparatus also comprises at least one glue applicator and distributor element for the production of a primary glue application on a peripheral surface of the glue roller which surrounds the roller axis and moves past a glue dispenser and at least one glue scraper which is provided on a glue scraper holder and is in contact with a scraper segment with an application force produced by at least one spring element against a peripheral area of the glue roller which extends in the direction of the roller axis and is downstream of the glue dispenser in the direction of rotation of the glue roller.

2. Background Information

Background information is for informational purposes only and does not necessarily admit that subsequently mentioned information and publications are prior art.

Some devices for the gluing of workpieces are for example for the gluing of curved pieces or rails made of flat goods. One feature that all these devices have in common is that for the application of the glue, there is a glue roller that extends into a pan-like glue container and rotates around a horizontal axis. To wipe off the excess glue on the glue roller, wipers are provided in these devices. Some of these wipers are held on a frame of the device in question only by means of leaf-spring-like elements or spring segments. In some cases, however, the wipers are also fastened to a holder which, for its part, is connected to the device frame by hinges or articulated joints. These devices are neither intended nor suitable for use as gluing devices in a labeling units.

Gluing devices for use in labeling machines, e.g. in labeling units of such machines, are known in a wide variety of realizations and comprise essentially a glue applicator and distributor element which is generally in the form of a bar or rail, and a glue roller which can be driven in rotation around its roller axis and is thereby moved past a glue dispenser of the glue applicator and distributor element. As part of this process, first a primary glue application is laid down, from which, by means of a glue scraper which is downstream of the glue dispenser in the direction of rotation of the glue roller, a uniform secondary glue application or glue film is produced, which is then transferred to the labels to be glued, either directly or indirectly by applying glue to label palettes with which the labels are subsequently extracted from a label magazine.

The glue scraper is in contact pivotably and flexibly, by means of spring means or with an application force generated by these spring means, against a scraper segment or scraper element on the peripheral surface of the glue roller. To achieve a uniform glue film at least on the area of the glue drum which is to be glued and to adjust the thickness of this glue film, in gluing devices of the prior art, complex devices are provided to calibrate and/or orient and/or adjust the spring-mounted glue scraper. One disadvantage of this design, among others, is that a contamination of the elements for the calibration and/or orientation and/or adjustment of the glue scraper and for the spring mounting are inevitable, primarily with glue and/or with foreign substances that are mixed with the glue, and these elements can thereby lose some or all or substantially all or most of their functional capabilities.

Some devices include a gluing apparatus for use in labeling machines comprising, among other things, a glue roller, a glue applicator and distributor element for the production of a primary glue application on the peripheral surface of the glue roller from a glue rail which is downstream of the glue applicator device in the direction of rotation of the glue roller and which, for the production of the glue film with the required film thickness, must be at an accurately specified or predetermined or desired distance from the periphery of the glue roller, and a scraper which is in contact against the glue roller and is formed by a spring plate with which any residual glue which is present on the glue roller is removed before any new application of glue. One of several disadvantages with this gluing apparatus is that to achieve the desired glue film thickness, a very precise adjustment of the glue rail is necessary or desired, and there can also be significant operational interruptions caused by foreign objects which are present on the peripheral surface of the glue roller, such as, for example, dried glue, bits and pieces of labels, etc. Because the glue roller is also subject to wear on its peripheral surface, a time-consuming recalibration of the glue rail is necessary or desired to maintain the required or desired distance.

Finally, some devices include a gluing apparatus in which the glue application to the glue roller is carried out by an applicator mechanism in the form of a tube with a longitudinal slot. There is no glue scraper for the realization of the glue film from the primary glue application, only a trowel-like scraper on the tubular applicator mechanism which is placed in contact against the glue roller during the pauses between labeling operations to remove residual glue by a pivoting of the glue applicator mechanism.

OBJECT OR OBJECTS

An object of the present application is to create labeling machine for labeling bottles or containers with labels which has a gluing apparatus which overcomes the above disadvantages.

SUMMARY

The present application teaches that this object can be accomplished by a gluing apparatus with at least one glue roller which can be driven so that it rotates around its roller axis, with at least one glue applicator and distributor element for the production of a primary glue application on a peripheral surface of the glue roller which surrounds the roller axis and moves past a glue dispenser, and with at least one glue scraper which is provided on a glue scraper holder. The at least one glue scraper is in contact with a scraper segment with an application force produced by at least one spring element against a peripheral area of the glue roller which extends in the direction of the roller axis and is downstream of the glue dispenser in the direction of rotation of the glue roller. The glue scraper and/or its scraper segment are held only with the at least one spring element on the glue scraper receptacle.

In the gluing apparatus according to the present application, the glue scraper and/or the scraper segment which is in contact against the glue roller and a scraper element that forms this scraper segment is/are fixed or clamped in position by at least one spring element on the device-side glue scraper receptacle, i.e. they are held in this receptacle without any hinges or articulated joints. Flexible mountings comprising rigid or adjustable bearings and independent spring elements for the application of the glue scraper against the glue roller 4 are completely eliminated, essentially eliminated, restricted, and/or minimized so that the risk of contamination and the related adverse effects on the operation of the glue scraper and of the overall gluing device can be eliminated, restricted, and/or minimized.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the present application are described according to the present occasion. The present application is explained in greater detail below with reference to the possible embodiment which is illustrated in the accompanying drawings, in which.

DESCRIPTION OF EMBODIMENT OR EMBODIMENTS

Figure 1:
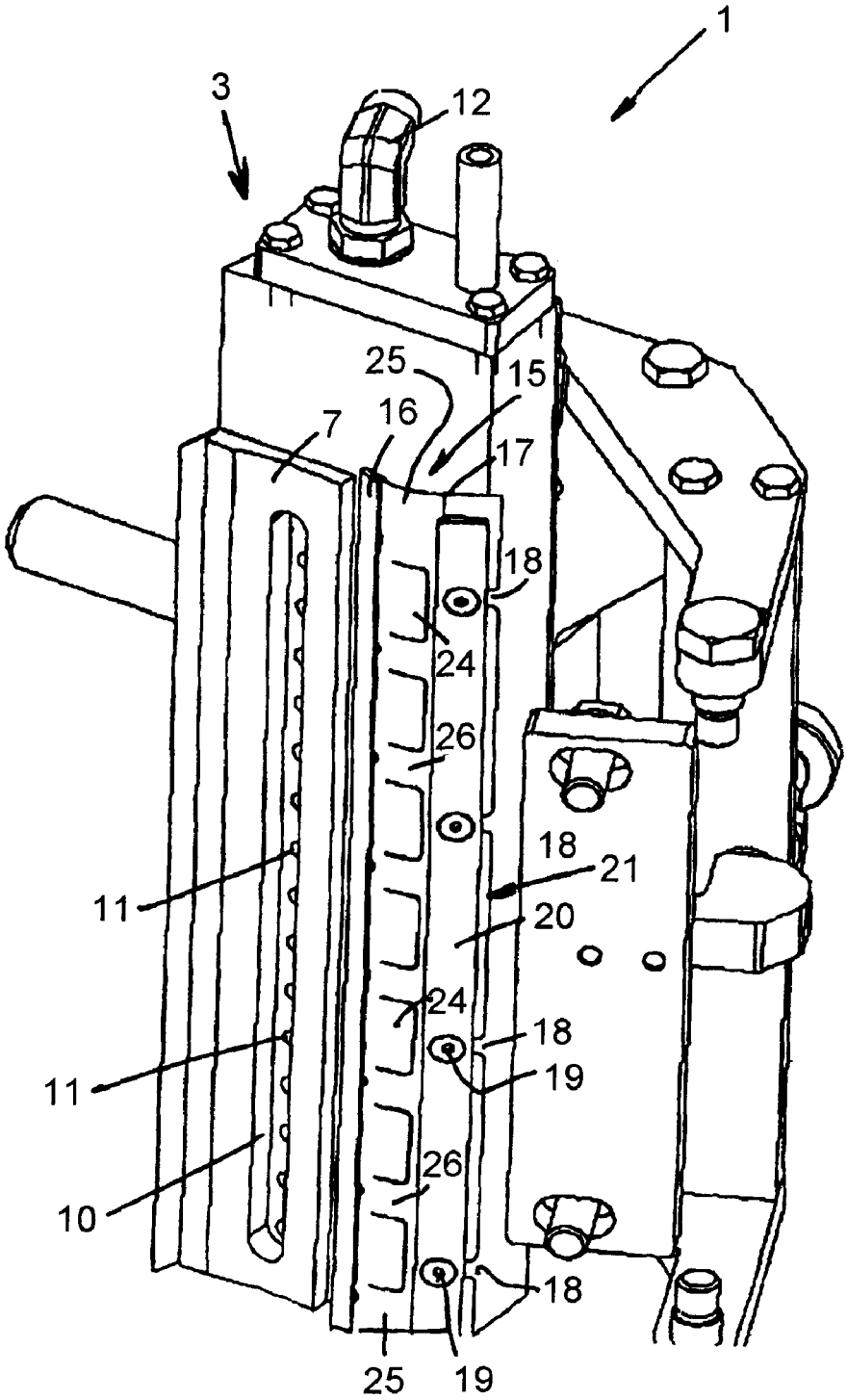
FIG. 1 is a view in perspective of a glue applicator and distributor element in the shape of a bar or rail of a gluing device for use in a labeling machine.

FIG. 1 shows a glue roller of a gluing or glue applicator apparatus of a labeling unit of a machine (not shown) for the labeling of bottles or similar containers.

The gluing apparatus comprises in the known manner an essentially rail-shaped glue applicator and distributor element 3, a glue roller 4 which is driven in rotation around a vertical roller axis, past which the labels 2 to be provided with the label glue (e.g. cold glue or hot glue) on the back and held on the periphery of a label transport cylinder 5 (e.g. a vacuum cylinder), or label palettes to which the glue is applied are moved in a manner which will be familiar to a technician skilled in the art of labeling units of the prior art. The glue roller 4 can be driven in rotation in the direction indicated by the arrow A and the label transport cylinder 5 can be driven in the direction of the arrow B.

The glue applicator and distributor element 3 has a rail-shaped housing 6 which is oriented with its longitudinal dimension parallel or virtually parallel to the axis of the glue roller 4, and forms on one longitudinal side a contact surface 7 which is curved concavely around the longitudinal axis of the housing, with which the glue applicator and distributor element 3 is in tight or mostly tight contact against the cylindrical peripheral surface of the glue roller 4 which concentrically surrounds the roller axis, and is in one possible embodiment pressed by spring elements 8 of a holder 9, by means of which the glue applicator and distributor element is held on a machine frame of the gluing device 1 or of the labeling unit.

On the contact surface 7, a glue chamber 10 which is open toward this surface is formed, which is in communication via a plurality of glue discharge and distributor openings 11 and a distributor duct which is realized in the housing 6 with a connection 12 which, when the gluing device 1 is in operation, is in communication with a glue pump (not shown). The groove-shaped glue chamber 10 is also oriented with its longitudinal axis parallel or virtually parallel to the axis of the glue roller 4. By means of the glue chamber 10, during the operation of the gluing device, a primary glue application in the form of a wave is laid down on the part of the peripheral surface of the glue roller that moves past the glue chamber 10, as shown in an exaggerated illustration in FIG. 4 as reference number 13.

To achieve the uniform secondary glue application required and/or desired for the gluing of the labels or a glue film (FIG. 4) with a specified or desired thickness, a glue scraper 15 is provided with a rail-shaped scraper segment or scraper element 16 which is pressed with its longitudinal dimension parallel or at least approximately parallel to the axis of the glue roller against the peripheral surface of the glue roller 4, and in one possible embodiment downstream of the glue chamber 10 in the direction of rotation A of the glue roller 4. The glue scraper 15 in the illustrated embodiment comprises the rail-shaped scraper element 16 and a rail-like spring plate 17 made of spring steel which supports the scraper element 16 on one long side and is fastened on the other long side in one possible embodiment for the positioning and orientation of the scraper element 16 adjustably on the housing 6 or on a fastening or clamping surface 6.1 located on the housing 6. The scraper element 16 has a rectangular cross section, for example, and is in one possible embodiment in contact with one of its two long cross section sides and/or with one of its edges against the peripheral surface of the glue roller 4.

For this adjustable fastening, the spring plate 17 has, on the long side facing away from the scraper element 16, a plurality of recesses 18 which are open toward this long side, each of which holds a clamping screw 19 which is engaged in a thread of the housing 6 as well as a clamping rail 20, so that the spring plate is held on its side facing away from the scraper element 16 by clamping between the clamp rail 20 and the clamping surface 6.1. The clamping surface 6.1, clamping screw 19 and clamping rail 20 therefore form an adjustable clamp fastening or clamp 21. The housing-side contact surface 6.1 which forms the clamp fastening 21 lies in a plane which intersects the peripheral surface of the glue roller 4 on a section or surface line parallel or virtually parallel to the axis of the glue roller, and in one possible embodiment so that this plane E encloses an angle α of less than ninety degrees with the peripheral surface of the glue roller 4 which opens in the direction of rotation of the glue roller. The line of intersection between the plane of the contact surface 6.1 and the peripheral surface of the glue roller 4 is also downstream of the scraper element 16 in the direction of rotation A of the glue roller.

Figure 2:
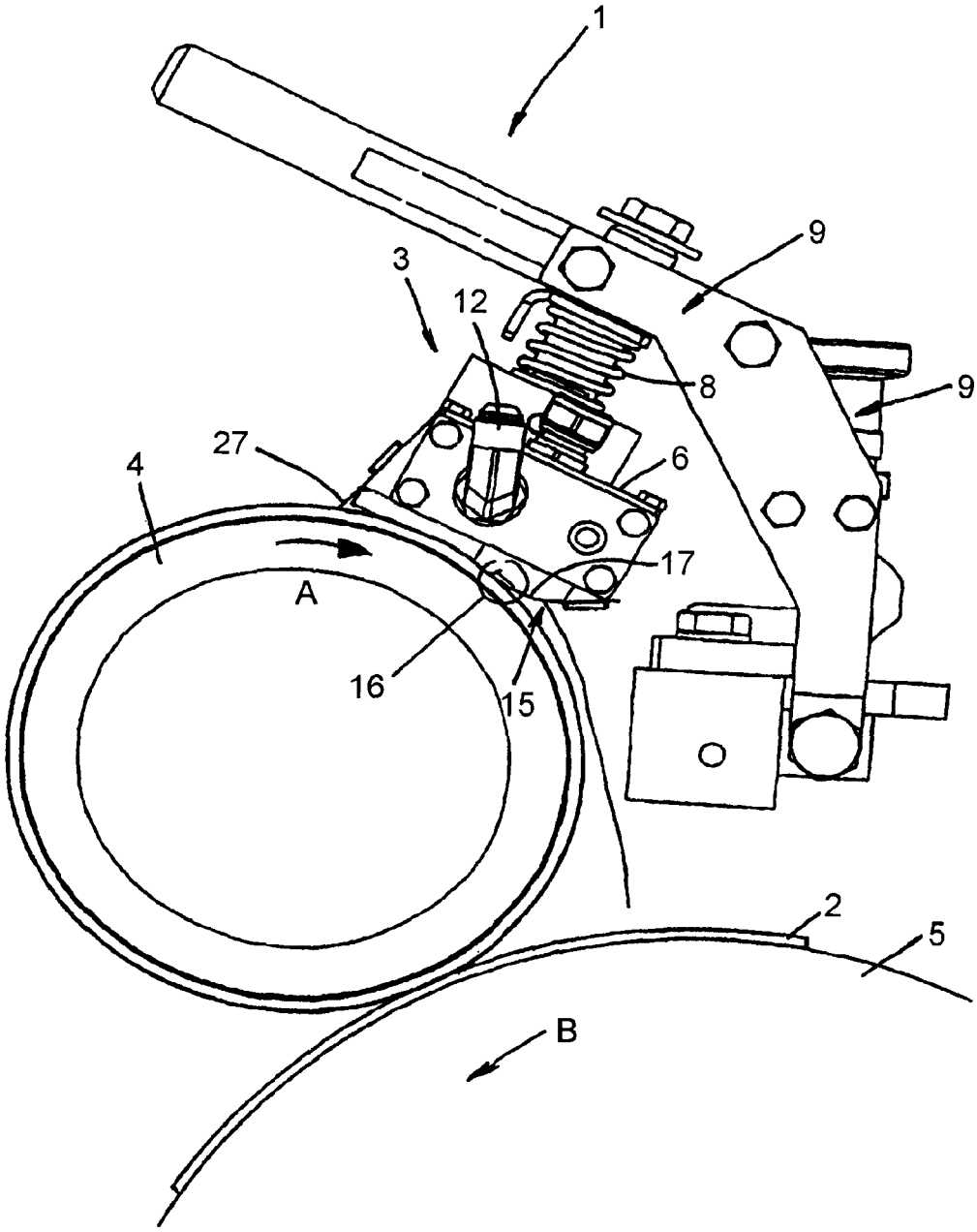
FIG. 2 is an overhead view of the glue applicator apparatus.
Figure 3:
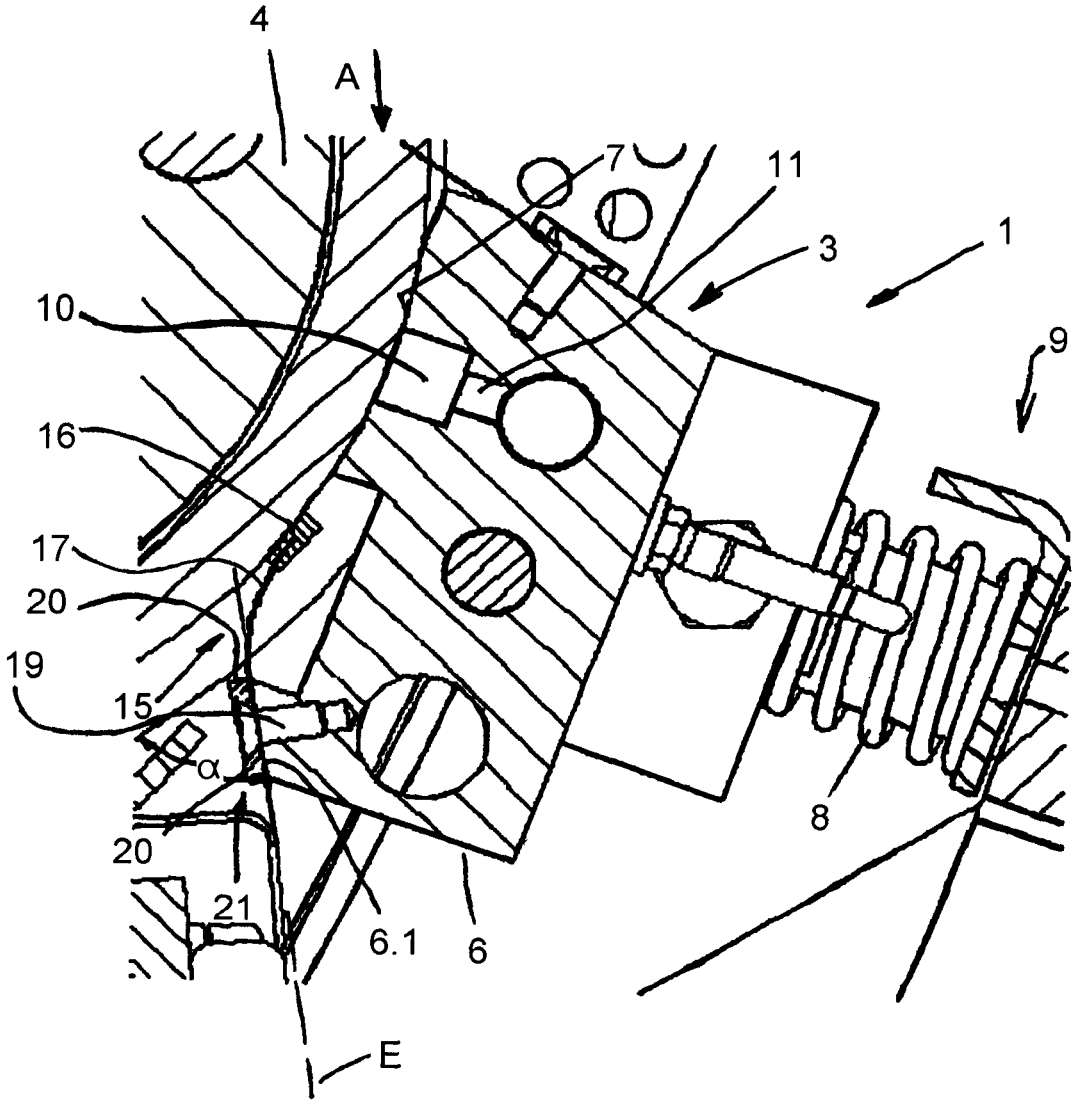
FIG. 3 is an enlarged detail from FIG. 2.
Figure 4:
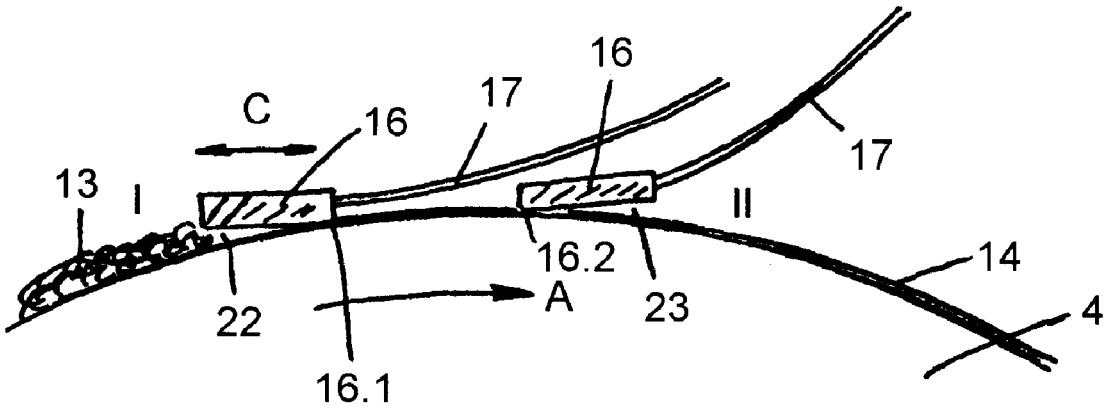
FIG. 4 is a schematic illustration in positions I and II of two different settings of the glue scraper and of the scraper element of the gluing apparatus.

The scraper element 16 is in contact against the peripheral surface of the glue roller 4 with the application force generated by the spring plate 17. The spring plate 17 is thereby concavely curved on its side facing away from the glue roller 4 and the side facing the housing 6 around at least one axis which extends in the longitudinal direction of the spring plate. As shown in FIGS. 2, 3 and 4 in one possible embodiment, the clamping of the spring plate 17 is designed so that it is downstream of the rail-shaped scraper element 16 in the direction of rotation A of the glue roller 4.

The gripper 21 makes possible not only an orientation of the glue scraper 15 so that the scraper element 16 is oriented with its longitudinal dimension as exactly parallel or substantially parallel as possible to the axis of the glue roller 4 but this gripper 21 also makes it possible to adjust the area in which the glue scraper 15 and its scraper element 16 are in contact against the periphery of the glue roller 4, as indicated by the double arrow X in FIG. 4. With this adjustment, therefore, it is possible on one hand to adjust the application force by which the scraper element is pressed by the spring plate 17 which acts as a leaf spring against the glue roller 4, and in one possible embodiment by varying the distance between the scraper element 16 and the gripper 21, and on the other hand the area by means of which the scraper element 16 is in linear contact against the periphery of the glue roller 4.

In FIG. 4, I and II represent two different settings of the glue scraper 15. In setting I, the scraper element 16 is in contact with the linear area 16.1 against the glue roller 4, and in one possible embodiment in the vicinity of the rear long side of the scraper element 16 with reference to the direction of rotation A, i.e. in the vicinity of that long side on which the scraper element 16 is connected with the spring plate 17. In setting I, on the forward long side in relation to the direction of rotation A, a space 22 is formed between the scraper element 16 and the glue roller which opens opposite to the direction of rotation A, by means of which a relatively large volume of the glue from the glue applicator 13 can get underneath the scraper element so that a glue film 14 with a relatively large thickness can be produced.

In the setting II, the scraper element is in contact with a linear area 16.2 against the periphery of the glue roller 4, so that there is a space 23 between the scraper element and the peripheral surface of the glue roller 4 which opens toward the rear in the direction of rotation A. In this setting, however, small quantities of glue from the glue applicator 13 can in any case get under the scraper element 16, so that a very thin glue film 14 is formed.

The glue scraper 15 can be set between the two extremes (settings I and II) to thereby achieve the desired thickness for the glue film 14.

The scraper element 16 is manufactured so that it is sufficiently flexible and elastically deformable, to achieve the most optimum contact possible with the scraper element 16 if the peripheral surface of the glue roller 4 is not exactly cylindrical. A suitable material for the scraper element 16 is brass, which essentially guarantees or promotes sufficient elasticity as well as sufficient strength and stability under load for the scraper element 16. As illustrated in FIG. 1, the spring plate 17 on its side supporting the scraper element 16 is in the form of a comb with a plurality of recesses 24 and webs 25 and 26, to essentially ensure or promote the most uniform possible contact of the scraper element 16 between the recesses 24 against the glue roller 4.

For the removal of any residual glue on the glue roller 4, there is a conventional wiper 27 in contact with the glue roller 4 on the forward longitudinal side of the glue applicator and distributor element 3 with reference to the direction of rotation A of the glue roller.

In at least one possible embodiment according to the present application, the glue scraper 15 and its scraper element 16 are held directly by the spring element which presses this glue scraper against the glue roller 4, namely the spring element 17 on the glue applicator and distributor element, i.e. any hinged or articulated connection between the glue scraper and a functional element that supports this glue scraper, such as the glue applicator and distributor elements, for example, or special spring means to press the glue scraper against the glue roller can be completely eliminated, substantially eliminated, restricted, and/or minimized along with the related disadvantages, in one possible embodiment with regard to any adverse effects on operation caused by dirt and contamination.

The above description is based on the assumption that the gripper 21 is formed by, among other things, a gripper surface 6.1 which is provided on the housing 6. Basically it is also possible to make the gripper 21 itself adjustable, and in one possible embodiment so that with this adjustment the angle of intersection α between the plane E and the peripheral surface of the glue roller 4 and thus also the application force with which the scraper element 16 presses against the glue roller 4 can be adjusted.

Figure 5:
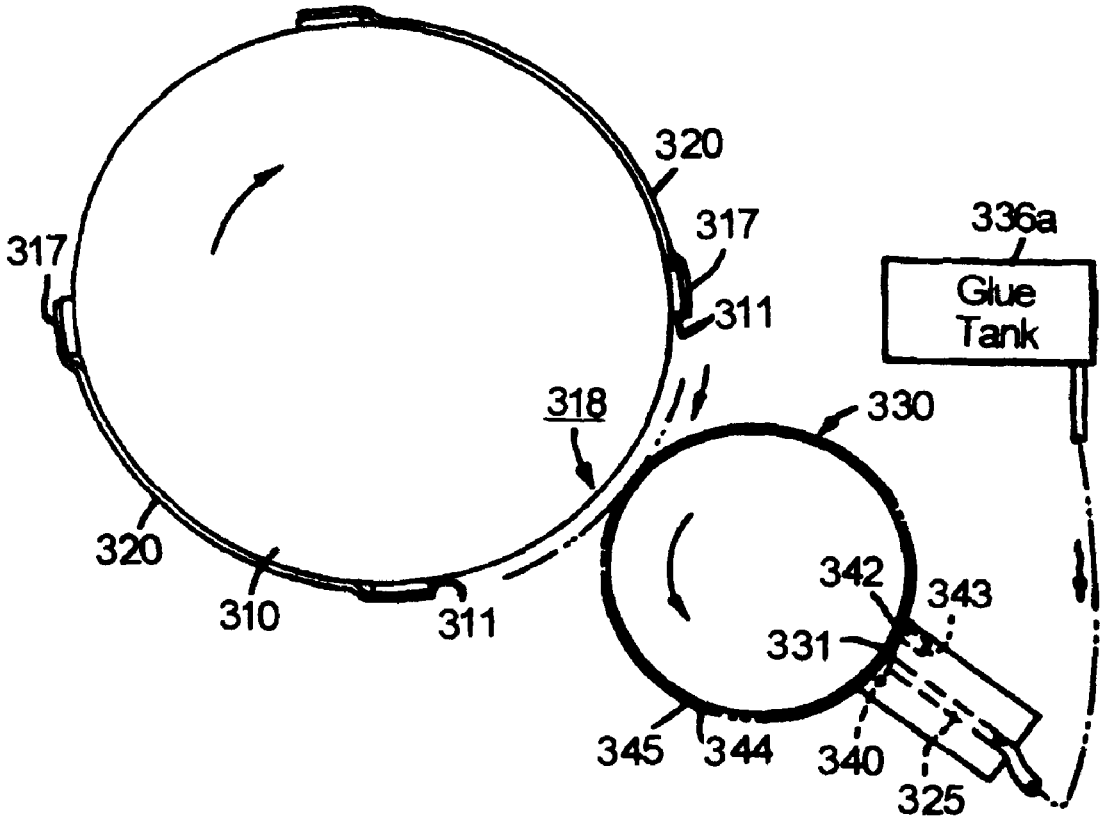
FIG. 5 PRIOR ART
FIG. 5 is a top view of an example of a glue roller and a glue bar assembly for a labeling machine for labeling bottles or containers.

FIG. 5 is a top view of an example of a glue roller and a glue bar assembly for a labeling machine for labeling bottles or containers, at least a portion of which could be utilized or adapted for use in at least one possible embodiment of the present application. FIG. 5 and at least a portion of the following description thereof may be found in U.S. Pat. No. 5,160,570, issued to inventor Dickey on Nov. 3, 1992, and entitled "Ultra High Speed Labeling Apparatus," which patent is incorporated by reference as if set forth in its entirety herein.

As shown in FIG. 5, a vacuum drum 310 carries to a labeling position glued labels 320 on its surface. As spinning containers reach the labeling position, labels are wrapped by contact between unlabeled bottles or containers and the glued leading edge 317 of the label 320 located on protrusion 311 of the vacuum drum 310. Labels 320 are formed by continuously feeding label stock via a roll to the vacuum drum 310. Pressure rollers advance the label stock through a cutter, which continuously severs predetermined lengths of label, while the leading edge 317 of the label 320 is held by suction onto protrusion 311 of vacuum drum 310.

After each label segment 320 is cut, it is positioned on the surface of vacuum drum 310 and rotated through a glue printing position 318 where glue is printed onto the label by glue roller 330 as shown. Protrusions 311 on vacuum drum 310 act as platens for printing of the leading and trailing edges of the label segment. Glue may alternatively be printed on only the leading edge of a label, leaving the trailing edge to be attached either to the container or to the leading edge by another means such as solvent or heat bonding.

The glue roller 330 as shown receives glue from the face of a glue bar 331. Glue is fed from glue tank 336A through internal glue channel 325 to the glue bar face 331 for application to the surface of rotating glue roller 330. Channel 325 leads to a triangular shaped, tapered opening 340 on the glue bar face 331. As glue enters tapered opening 340, the rotation of glue roller 330 causes build up of suitable pressures in the tapered configuration 340 so as to force glue into the patterned surface formed by grooves 344 between knurls 345 on the glue roll 330. Other patterns which result in a similar operation will be apparent to those of ordinary skill in the art.

FIG. 5 shows the taper 340 to be an angle of 15°. This angle refers to the acute angle formed at the intersection of the downstream and phantom sidewalls of the triangular shaped opening. The invention may successfully create suitable pressures at other angles of taper between 5° and 45°. Taper 340 may also peak at a point which is offset from the centerline of glue channel 325. Alternative taper configurations develop varying patterns of pressuring glue into the knurled face of glue roller 330.

Excess glue collects in hollow 343. Edge 342, downstream of the tapered opening 340 on the glue bar face wipes and doctors off excess glue on the surface of glue roller 330 and collects it in vertically disposed hollow 343. The glue is spread by edge 342 and excess glue runs into hollow 343, where it may be collected for recirculation.

Figure 6:
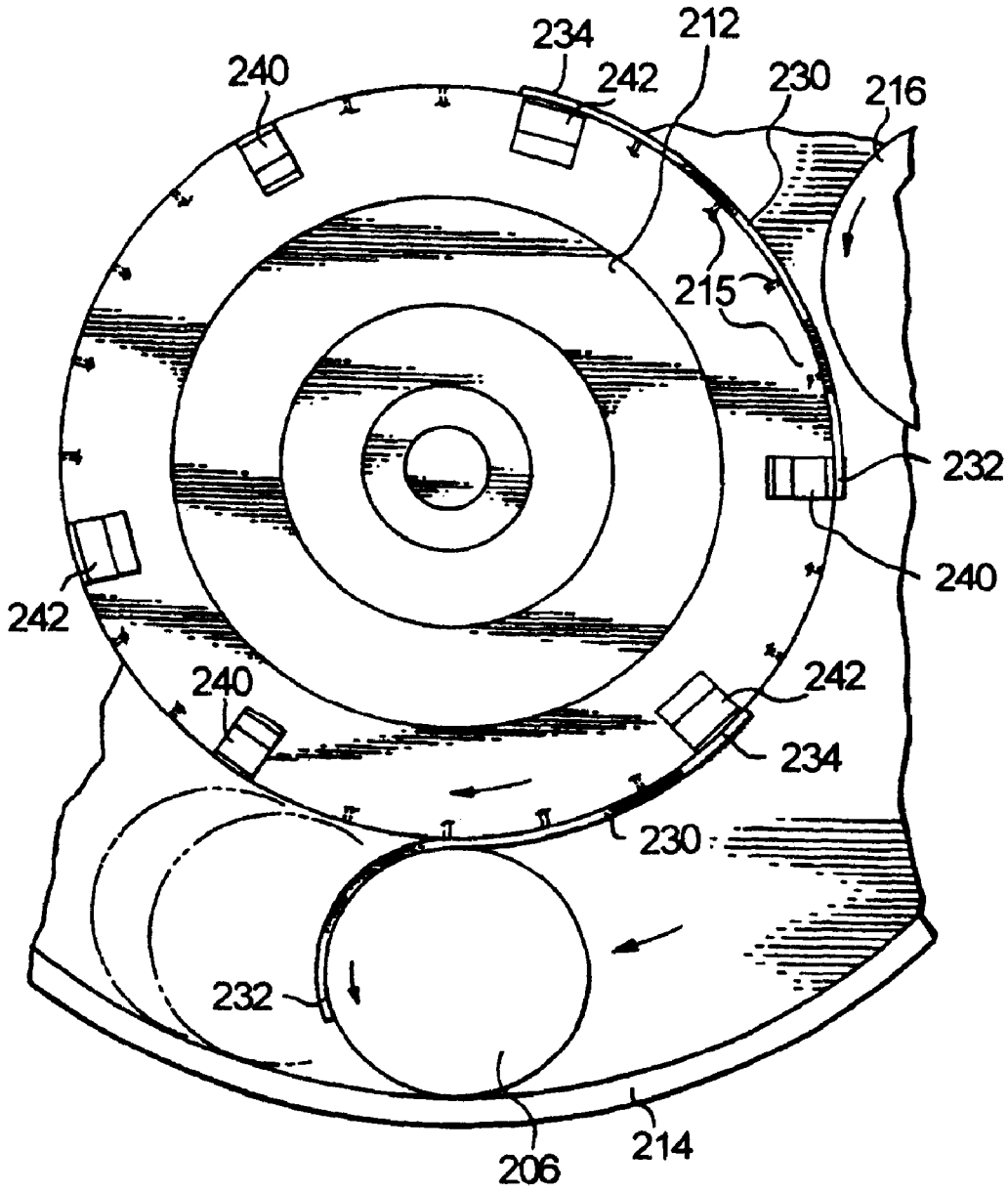
FIG. 6 PRIOR ART
FIG. 6 is a top view of an example of a labeling mechanism in which a label is being transferred to a bottle or container from a vacuum drum.

FIG. 6 is a top view of an example of a labeling mechanism in which a label is being transferred to a bottle or container from a vacuum drum, at least a portion of which could be utilized or adapted for use in at least one possible embodiment of the present application. FIG. 6 and at least a portion of the following description thereof may be found in U.S. Pat. No. 4,758,300, issued to inventors King, et al. on Jul. 19, 1988, and entitled "High Speed Labelling Machine," which patent is incorporated by reference as if set forth in its entirety herein.

As shown in FIG. 6, a vacuum drum 212 has a label 230 secured thereto and held against the vacuum drum by suction through the various ports generally shown as 215 which are found throughout the drum surface. The leading edge 232 of the label 230 overlies leading pad 240 with the trailing edge 234 of the label overlying the trailing pad 242. Glue has been applied to the leading edge 232 as pad 240 is forced outwardly, bringing the label into contact with the glue column. As the trailing portion 234 is advanced past the glue column 216, a cam member will actuate the trailing pad 242 forcing the trailing portion 234 of the label into contact with the glue column 216. Upstream of the label that is being advanced past the glue column is a further set of pads and an associated label which is partially wrapped about an article 206 with the leading edge 232 in securement with the article and the trailing edge 234 still in contact with the trailing pad 242. The rail 214 ensures that the article 206 remains in contact with the vacuum drum a time sufficient to complete the wrapping of the label about the article.

With reference to FIG. 6, three sets of pads are positioned about the vacuum drum and are designed to accommodate one label between each set of pads. The pads are controlled to bring the leading or trailing edge of a label into contact with the glue column 216 as the label passes the glue column. The pads then return to their initial position which forms part of the cylindrical surface of the vacuum drum 212. In this way, the wrapping of the label about the article to be labelled is easier as the surface of the vacuum drum remains consistent. In some other labeling machines, the leading and trailing edges of the label extend outwardly of the general periphery of the vacuum drum at all times and the glue column is moved out of contact with the surface if a label is not present.

Another example of a labeling machine for labeling bottles, at least a portion of which could be utilized or adapted for use in at least one possible embodiment of the present application, may possibly be found in U.S. Pat. No. 7,509,786, issued to inventor Thatenhorst on Jul. 19, 1988, and entitled "Beverage Bottling Plant for Filling Bottles with a Liquid Filling Material with an Adjustable Labeling Mechanism for Labeling Bottles, and a Method of Operating a Beverage Bottling Plant," which patent is incorporated by reference as if set forth in its entirety herein.

Figure 7:
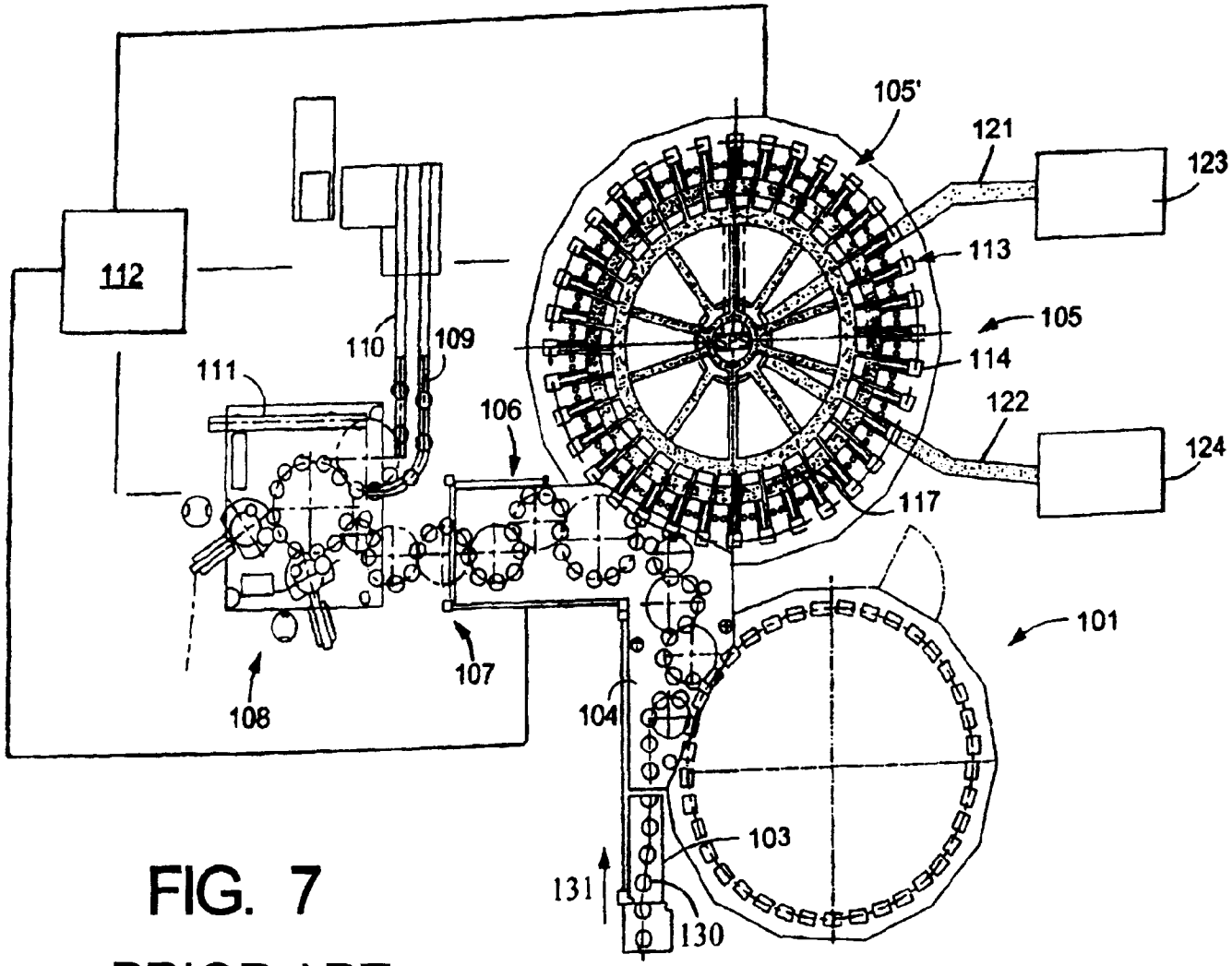
FIG. 7 PRIOR ART
FIG. 7 shows schematically the main components of one possible embodiment example of a system for filling containers, specifically, a beverage bottling plant for filling bottles with at least one liquid beverage.

FIG. 7 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 7 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 7, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Gluing apparatus with at least one glue roller which can be driven so that it rotates around its roller axis, with at least one glue applicator and distributor element for the production of a primary glue application on a peripheral surface of the glue roller and with at least one glue scraper which is in contact with a scraper segment with an application force produced by at least one spring element against a peripheral area of the glue roller that extends in the direction of the roller axis and the peripheral area of the glue roller downstream of the glue dispenser in the direction of rotation of the glue roller.

One feature or aspect of an embodiment is believed at the time of the filing of this patent application to possibly reside broadly in a gluing apparatus with at least one glue roller 4 which can be driven so that it rotates around its roller axis, with at least one glue applicator and distributor element 3 for the production of a primary glue application on a peripheral surface of the glue roller 4 which surrounds the roller axis and moves past a glue chamber 10, and with at least one glue scraper 15 which is provided on a glue scraper holder and is in contact with a scraper segment 16 with an application force produced by at least one spring element against a peripheral area of the glue roller 4 which extends in the direction of the roller axis and is downstream of the glue chamber 10 in the direction of rotation A of the glue roller, wherein the glue scraper 15 and/or its scraper segment 16 are held with the at least one spring element 17 on the glue scraper receptacle 21.

Another feature or aspect of an embodiment is believed at the time of the filing of this patent application to possibly reside broadly in the gluing apparatus, wherein the glue scraper 15 is held on the glue scraper receptacle 21 so that the scraper segment 16 which is pressing against the glue roller 4 is front of the remaining portion of the glue scraper 15 in the direction of rotation A of the glue roller.

Yet another feature or aspect of an embodiment is believed at the time of the filing of this patent application to possibly reside broadly in the gluing apparatus, wherein the scraper segment 16 which is in contact against the glue roller 4 is in the shape of a rail or bar.

Still another feature or aspect of an embodiment is believed at the time of the filing of this patent application to possibly reside broadly in the gluing apparatus, wherein the scraper segment 16 has a rectangular cross section and is in contact with one of its larger cross section sides or with one of its edges against the glue roller 4.

A further feature or aspect of an embodiment is believed at the time of the filing of this patent application to possibly reside broadly in the gluing apparatus, wherein the at least one spring element is realized in the form of a leaf spring.

Another feature or aspect of an embodiment is believed at the time of the filing of this patent application to possibly reside broadly in the gluing apparatus, wherein the glue scraper receptacle 21 is provided on the glue applicator or distributor element.

Yet another feature or aspect of an embodiment is believed at the time of the filing of this patent application to possibly reside broadly in the gluing apparatus, wherein the glue scraper receptacle is realized in the form of a clamp fastener 21 with an apparatus-side contact or clamping surface 6.1, which is oriented in a plane E that is parallel or approximately parallel to the roller axis and intersects the peripheral surface of the gluing roller 4.

Still another feature or aspect of an embodiment is believed at the time of the filing of this patent application to possibly reside broadly in the gluing apparatus, wherein the plane E of the clamping surface 6.1 intersects the peripheral surface of the gluing roller 4 at an angle $\alpha$ of less than ninety degrees which is open in the direction of rotation A of the gluing roller.

A further feature or aspect of an embodiment is believed at the time of the filing of this patent application to possibly reside broadly in the gluing apparatus, wherein the glue scraper receptacle 21 is realized for a setting or adjustment of the glue scraper 15 or of the scraper element 16 relative to the gluing roller 4 and/or relative to the glue applicator and distributor element 3.

Another feature or aspect of an embodiment is believed at the time of the filing of this patent application to possibly reside broadly in the gluing apparatus, wherein the at least one spring element 17 is fastened to the glue scraper receptacle 21.

Yet another feature or aspect of an embodiment is believed at the time of the filing of this patent application to possibly reside broadly in the gluing apparatus, wherein the at least one spring element is a portion of the glue scraper 15 that has the scraper segment 16.

Still another feature or aspect of an embodiment is believed at the time of the filing of this patent application to possibly reside broadly in the gluing apparatus, wherein the at least one spring element is formed by at least one spring plate 17 which has on one side, in one possible embodiment on a long side, the scraper segment 16 and is fastened to the apparatus-side receptacle 21 on an opposite side, in one possible embodiment a long side.

A further feature or aspect of an embodiment is believed at the time of the filing of this patent application to possibly reside broadly in the gluing apparatus, wherein the scraper segment 16 is manufactured in one piece with the at least one spring plate 17 or is connected to it.

One feature or aspect of an embodiment is believed at the time of the filing of this patent application to possibly reside broadly in the gluing apparatus, wherein the scraper segment is formed by a scraper element 16 in the shape of a bar or rail.

Another feature or aspect of an embodiment is believed at the time of the filing of this patent application to possibly reside broadly in the gluing apparatus, wherein the at least one spring plate 17 is realized on its side supporting the rail-like scraper element 16 in the form of a comb with recesses 24 and webs 26 between them.

Yet another feature or aspect of an embodiment is believed at the time of the filing of this patent application to possibly reside broadly in the gluing apparatus, wherein the scraper element 16 is realized so that it is elastically deformable.

Still another feature or aspect of an embodiment is believed at the time of the filing of this patent application to possibly reside broadly in the gluing apparatus, wherein the scraper element 15 is made of brass.

A further feature or aspect of an embodiment is believed at the time of the filing of this patent application to possibly reside broadly in a gluing apparatus with at least one glue roller 4 which can be driven so that it rotates around its roller axis, with at least one glue applicator and distributor element 3 for the production of a primary glue application on a peripheral surface of the glue roller 4 which surrounds the roller axis and moves past a glue chamber 10, and with at least one glue scraper 15 which is provided on a glue scraper holder and is in contact with a scraper segment 16 with an application force produced by at least one spring element against a peripheral area of the glue roller 4 which extends in the direction of the roller axis and is downstream of the glue chamber 10 in the direction of rotation A of the glue roller, wherein the glue scraper 15 and/or its scraper segment 16 are held only with the at least one spring element 17 on the glue scraper receptacle 21 so that the scraper segment 16 which is pressing against the glue roller 4 is front of the remaining portion of the glue scraper 15 in the direction of rotation A of the glue roller, and the scraper segment 16 which is in contact against the glue roller 4 is in the shape of a rail or bar.

Another feature or aspect of an embodiment is believed at the time of the filing of this patent application to possibly reside broadly in the gluing apparatus, wherein the scraper segment 16 has a rectangular cross section and is in contact with one of its larger cross section sides or with one of its edges against the glue roller 4.

Yet another feature or aspect of an embodiment is believed at the time of the filing of this patent application to possibly reside broadly in the gluing apparatus, wherein the at least one spring element 17 is realized in the form of a leaf spring.

Still another feature or aspect of an embodiment is believed at the time of the filing of this patent application to possibly reside broadly in the gluing apparatus, wherein the glue scraper receptacle 21 is provided on the glue applicator or distributor element.

A further feature or aspect of an embodiment is believed at the time of the filing of this patent application to possibly reside broadly in the gluing apparatus, wherein the glue scraper receptacle is realized in the form of a clamp fastener 21 with an apparatus-side contact or clamping surface 6.1, which is oriented in a plane E that is parallel or approximately parallel to the roller axis and intersects the peripheral surface of the gluing roller 4.

Another feature or aspect of an embodiment is believed at the time of the filing of this patent application to possibly reside broadly in the gluing apparatus, wherein the plane E of the clamping surface 6.1 intersects the peripheral surface of the gluing roller 4 at an angle $\alpha$ of less than ninety degrees which is open in the direction of rotation A of the gluing roller.

Yet another feature or aspect of an embodiment is believed at the time of the filing of this patent application to possibly reside broadly in the gluing apparatus, wherein the glue scraper receptacle 21 is realized for a setting or adjustment of the glue scraper 15 or of the scraper element 16 relative to the gluing roller 4 and/or relative to the glue applicator and distributor element 3.

Still another feature or aspect of an embodiment is believed at the time of the filing of this patent application to possibly reside broadly in the gluing apparatus, wherein the at least one spring element 17 is fastened to the glue scraper receptacle 21.

A further feature or aspect of an embodiment is believed at the time of the filing of this patent application to possibly reside broadly in the gluing apparatus, wherein the at least one spring element is a portion of the glue scraper 15 that has the scraper segment 16.

One feature or aspect of an embodiment is believed at the time of the filing of this patent application to possibly reside broadly in the gluing apparatus, wherein the at least one spring element is formed by at least one spring plate 17 which has on one side, preferably on a long side, the scraper segment 16 and is fastened to the apparatus-side receptacle 21 on an opposite side, in one possible embodiment a long side.

Another feature or aspect of an embodiment is believed at the time of the filing of this patent application to possibly reside broadly in the gluing apparatus, wherein the scraper segment 16 is manufactured in one piece with the at least one spring plate 17 or is connected to it.

Yet another feature or aspect of an embodiment is believed at the time of the filing of this patent application to possibly reside broadly in the gluing apparatus, wherein the scraper segment is formed by a scraper element 16 in the shape of a bar or rail.

Still another feature or aspect of an embodiment is believed at the time of the filing of this patent application to possibly reside broadly in the gluing apparatus, wherein the at least one spring plate 17 is realized on its side supporting the rail-like scraper element 16 in the form of a comb with recesses 24 and webs 26 between them.

A further feature or aspect of an embodiment is believed at the time of the filing of this patent application to possibly reside broadly in the gluing apparatus, wherein the scraper element 16 is realized so that it is elastically deformable.

Another feature or aspect of an embodiment is believed at the time of the filing of this patent application to possibly reside broadly in the gluing apparatus, wherein the scraper element 15 is made of brass.

Yet another feature or aspect of an embodiment is believed at the time of the filing of this patent application to possibly reside broadly in a beverage bottling plant for filling beverage bottles with liquid beverage material, said beverage bottling plant comprising: a plurality of rotary machines comprising at least a rotary beverage bottle filling machine, a rotary beverage bottle closing machine, and a rotary beverage bottle labeling machine; a first conveyor arrangement being configured and disposed to convey beverage bottles to be filled to said beverage bottle filling machine; said beverage bottle filling machine being configured and disposed to fill beverage bottles with liquid beverage material; said beverage bottle filling machine comprising: a rotor; a rotatable vertical machine column; said rotor being connected to said vertical machine column to permit rotation of said rotor about said vertical machine column; a plurality of beverage bottle filling elements for filling beverage bottles with liquid beverage material being disposed on the periphery of said rotor; each of said plurality of beverage bottle filling elements comprising a container carrier being configured and disposed to receive and hold beverage bottles to be filled; each of said plurality of beverage bottle filling elements being configured and disposed to dispense liquid beverage material into beverage bottles to be filled; at least one liquid reservoir being configured to hold a supply of liquid beverage material; at least one supply line being configured and disposed to connect said at least one liquid reservoir to said beverage bottle filling machine to supply liquid beverage material to said beverage bottle filling machine; a first star wheel structure being configured and disposed to move beverage bottles into said beverage bottle filling machine; and a second star wheel structure being configured and disposed to move beverage bottles out of said beverage bottle filling machine; a second conveyor arrangement being configured and disposed to convey filled beverage bottles from said beverage bottle filling machine to said beverage bottle closing machine; said beverage bottle closing machine being configured and disposed to close tops of filled beverage bottles; said beverage bottle closing machine comprising: a rotor; a rotatable vertical machine column; said rotor being connected to said vertical machine column to permit rotation of said rotor about said vertical machine column; a plurality of closing devices being disposed on the periphery of said rotor; each of said plurality of closing devices being configured and disposed to place closures on filled beverage bottles; each of said plurality of closing devices comprising a container carrier being configured and disposed to receive and hold filled beverage bottles; a first star wheel structure being configured and disposed to move filled beverage bottles into said beverage bottle closing machine; and a second star wheel structure being configured and disposed to move filled, closed beverage bottles out of said beverage bottle closing machine; a third conveyor arrangement being configured and disposed to convey filled, closed beverage bottles from said beverage bottle closing machine to said beverage bottle labeling machine; said beverage bottle labeling machine being configured and disposed to label filled, closed beverage bottles; and said beverage bottle labeling machine comprising: a rotor; a rotatable vertical machine column; said rotor being connected to said vertical machine column to permit rotation of said rotor about said vertical machine column; a plurality of beverage bottle support structures being disposed on the periphery of said rotor; said beverage bottle support structures being configured to support and hold filled, closed beverage bottles; a first star wheel structure being configured and disposed to move filled, closed beverage bottles into said beverage bottle labeling machine; a second star wheel structure being configured and disposed to move labeled beverage bottles out of said beverage bottle labeling machine; at least one beverage bottle labeling device being configured and disposed to affix a label to the surface of a beverage bottle; and said at least one beverage bottle labeling device comprising: a transport cylinder being configured to hold labels on the outer surface thereof and transfer labels onto beverage bottles; a glue roller being disposed adjacent said transport cylinder and being configured to rotate around a roller axis and transfer glue onto labels; said transport cylinder being configured and disposed to rotate and transport labels thereon past said glue roller to permit application of glue on the labels by said glue roller; a glue applicator and distributor arrangement being configured to apply and distribute glue on the outer surface of said glue roller; said glue applicator and distributor arrangement comprises a glue dispenser, a glue scraper, and a glue scraper holder; said glue scraper being disposed downstream of said glue dispenser in the direction of rotation of said glue roller; said glue dispenser comprises at least one dispensing orifice disposed a distance from said glue roller and being configured to dispense glue onto the outer surface of said glue roller; said glue scraper having a length, a width, and a thickness, wherein the length of said glue scraper is substantially greater than the width and the thickness; said glue scraper being disposed such that the length of said glue scraper runs substantially parallel to and along the roller axis of said glue roller; said glue scraper comprises a spring element and a scraper segment disposed on a first end of said spring element; said spring element being configured to produce a force to press at least a portion of said scraper segment against a portion of the outer surface of said glue roller; said spring element having a second end opposite said first end inserted into and held by said glue scraper holder; and said glue scraper is held and supported only by said glue scraper holder.

Still another feature or aspect of an embodiment is believed at the time of the filing of this patent application to possibly reside broadly in, in a beverage bottling plant for filling beverage bottles with liquid beverage material having a plurality of rotary machines such as a rotary beverage bottle filling machine, a rotary beverage bottle closing machine, and a rotary beverage bottle labeling machine, a beverage bottle labeling machine comprising: a rotor; a rotatable vertical machine column; said rotor being connected to said vertical machine column to permit rotation of said rotor about said vertical machine column; a plurality of beverage bottle support structures being disposed on the periphery of said rotor; said beverage bottle support structures being configured to support and hold filled, closed beverage bottles; at least one beverage bottle labeling device being configured and disposed to affix a label to the surface of a beverage bottle; and said at least one beverage bottle labeling device comprising: a transport cylinder being configured to hold labels on the outer surface thereof and transfer labels onto beverage bottles; a glue roller being disposed adjacent said transport cylinder and being configured to rotate around a roller axis and transfer glue onto labels; said transport cylinder being configured and disposed to rotate and transport labels thereon past said glue roller to permit application of glue on the labels by said glue roller; a glue applicator and distributor arrangement being configured to apply and distribute glue on the outer surface of said glue roller; said glue applicator and distributor arrangement comprises a glue dispenser, a glue scraper, and a glue scraper holder; said glue scraper being disposed downstream of said glue dispenser in the direction of rotation of said glue roller; said glue dispenser comprises at least one dispensing orifice disposed a distance from said glue roller and being configured to dispense glue onto the outer surface of said glue roller; said glue scraper having a length, a width, and a thickness, wherein the length of said glue scraper is substantially greater than the width and the thickness; said glue scraper being disposed such that the length of said glue scraper runs substantially parallel to and along the roller axis of said glue roller; said glue scraper comprises a spring element and a scraper segment disposed on a first end of said spring element; said spring element being configured to produce a force to press at least a portion of said scraper segment against a portion of the outer surface of said glue roller; said spring element having a second end opposite said first end inserted into and held by said glue scraper holder; and said glue scraper is held and supported only by said glue scraper holder.

A further feature or aspect of an embodiment is believed at the time of the filing of this patent application to possibly reside broadly in, in a container filling plant for filling containers with a product having a plurality of container handling machines such as a container filling machine, a container closing machine, and a container labeling machine, a container labeling machine comprising: a rotor; a rotatable vertical machine column; said rotor being connected to said vertical machine column to permit rotation of said rotor about said vertical machine column; a plurality of container support structures being disposed on the periphery of said rotor; said container support structures being configured to support and hold filled, closed containers; at least one container labeling device being configured and disposed to affix a label to the surface of a container; and said at least one container labeling device comprising: a transport device being configured to hold labels and transfer labels onto containers; an adhesive roller being disposed adjacent said transport device and being configured to rotate around a roller axis and transfer adhesive onto labels; said transport device being configured and disposed to transport labels thereon past said adhesive roller to permit application of adhesive on the labels by said adhesive roller; an adhesive applicator and distributor arrangement being configured to apply and distribute adhesive on the outer surface of said adhesive roller; said adhesive applicator and distributor arrangement comprises an adhesive dispenser, an adhesive scraper, and an adhesive scraper holder; said adhesive scraper being disposed downstream of said adhesive dispenser in the direction of rotation of said adhesive roller; said adhesive dispenser comprises at least one dispensing orifice disposed a distance from said adhesive roller and being configured to dispense adhesive onto the outer surface of said adhesive roller; said adhesive scraper having a length, a width, and a thickness, wherein the length of said adhesive scraper is substantially greater than the width and the thickness; said adhesive scraper being disposed such that the length of said adhesive scraper runs substantially parallel to and along the roller axis of said adhesive roller; said adhesive scraper comprises a spring element and a scraper segment disposed on a first end of said spring element; said spring element being configured to produce a force to press at least a portion of said scraper segment against a portion of the outer surface of said adhesive roller; said spring element having a second end opposite said first end inserted into and held by said adhesive scraper holder; and said adhesive scraper is held and supported only by said adhesive scraper holder.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Mar. 10, 2008, and/or cited elsewhere are hereby incorporated by reference as if set forth in their entirety herein as follows: U.S. Pat. No. 3,795,221, having the title "APPLICATOR FOR CONTROLLABLY APPLYING A LIQUID DEPOSIT TO VARIOUS WORKPIECES," published on Mar. 5, 1974; EP 0 571 849, having the following English translation of the German title "COATING DEVICE FOR MOVING WEBS," published on Dec. 1, 1993; U.S. Pat. No. 3,659,553, having the title "ADJUSTING DOCTOR BLADE ARRANGEMENT FOR USE WITH A DRUM APPLICATOR," published on May 2, 1972; U.S. Pat. No. 2,946,307, having the title "APPARATUS FOR COATING PAPER," published on Jul. 26, 1960; DE 44 44 779, having the following English translation of the German title "APPLICATOR FOR COATING A MOVING WEB," published on Jun. 20, 1996; U.S. Pat. No. 4,848,268, having the title "APPARATUS AND METHOD FOR APPLYING A LIQUID TO A MOVING WEB," published on Jul. 18, 1989; EP 0 311 728, having the following English translation of the German title "DOCTORING DEVICE," published on Apr. 19, 1989; U.S. Pat. No. 4,889,071, having the title "UPSTREAMS INCLINED DOCTOR BLADE," published on Dec. 26, 1989; and WO 97/38797, having the title "DEVICE FOR APPLICATION OF GLUE ON OBJECTS," published on Oct. 23, 1997.

All of the patents, patent applications or patent publications, which were cited in the German Office Action dated May 29, 2007, and/or cited elsewhere are hereby incorporated by reference as if set forth in their entirety herein as follows: CH 40 774 A, having the German title "LEIMAUFTRAGEMASCHINE MIT LEIMABSTREICHLEISTE AN EINER LEIMAUFTRAGEWALZE," published Aug. 17, 1908; U.S. Pat. No. 3,735,733 A, having the title "APPLICATOR FOR PAPER HANDLING APPARATUS," published on May 29, 1973; DE 202 20 132 U1, having the following English translation of the German title "ADHESIVE APPLICATOR FOR LABELLING MACHINE, INCLUDES SCRAPER FOR REMOVING ADHESIVE RESIDUE AND FOREIGN BODIES FROM ROLL," published on Apr. 15, 2004; and DD 145 620 A5, having the German title "ETIKETTIERSTATION EINER ETIKETTIERMASCHINE FUER FLASCHEN," published on Dec. 24, 1980.

The patents, patent applications, and patent publications listed above in the three preceding paragraphs are incorporated by reference as if set forth in their entirety herein. The purpose of incorporating U.S. patents, foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 051 360.6, filed on Oct. 27, 2006, having inventors Klaus KRÄMER, Lutz DECKERT, and Oliver KRESS, and DE-OS 10 2006 051 360.6 and DE-PS 10 2006 051 360.6, and International Application No. PCT/EP2007/009215, filed on Oct. 24, 2007, having WIPO Publication No. WO2008/049592 and inventors Klaus KRÄMER, Lutz DECKERT, and Oliver KRESS, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/009215 and German Patent Application 10 2006 051 360.6 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/009215 and DE 10 2006 051 360.6 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Gluing apparatus
2 Label
3 Glue applicator or distributor element
4 Glue roller
5 Label transport cylinder, e.g. vacuum cylinder
6 Housing
6.1 Clamping surface
7 Contact surface
8 Spring element
9 Holding mechanism
10 Glue duct
11 Distributor opening in the bottom of the glue duct 10
12 Connection for glue pump
13 Glue application applied in the form of a wave
14 Glue film
15 Glue scraper
16 Scraper bar or scraper element
17 Spring plate
18 Recesses in the spring plate
19 Clamping screw
20 Clamp rail
21 Adjustable clamping of the spring plate 17
22, 23 Space between the scraper rail 16 and the glue roller
24 Recess
25, 26 Web
27 Wiper
A Direction of rotation of the glue roller
B Direction of rotation of the label transport cylinder 5
C Setting of the glue scraper 15 or of the scraper rail 16
E Plane
$\alpha$ Angle

What is claimed is:

1. A container labeling machine gluing apparatus comprising:

a rotatable glue roller being configured to apply glue to labels;

a glue scraper configured to scrape glue off of said glue roller;

a glue dispenser being configured to dispense glue onto said glue roller;

a glue thickness adjuster being disposed downstream of said glue dispenser and being configured to adjust thickness of a glue layer on said glue roller prior to application of glue to labels;

said glue thickness adjuster comprising a spring element and a glue contact element connected to said spring element;

said spring element being configured to press said glue contact element toward said glue roller and into contact with glue on said glue roller; and said glue contact element being disposed upstream of remaining portions of its glue thickness adjuster in the direction of rotation of said glue roller, and said glue contact element points in the direction opposite the direction of rotation of said glue roller and away from remaining portions of said glue thickness adjuster.

2. The container labeling machine gluing apparatus according to claim 1, wherein said glue contact element is solely supported by said spring element.

3. The container labeling machine gluing apparatus according to claim 2, wherein said glue contact element is in the shape of a rail or bar.

4. The container labeling machine gluing apparatus according to claim 3, wherein said glue contact element has a rectangular cross section and is in contact with one of its larger cross-section sides or with one of its edges against glue on said glue roller.

5. The container labeling machine gluing apparatus according to claim 4, wherein said spring element comprises a leaf spring.

6. The container labeling machine gluing apparatus according to claim 5, further comprising a housing configured to house said glue dispenser, and wherein said glue thickness adjuster is adjustably fastened to said housing.

7. The container labeling machine gluing apparatus according to claim 6, wherein said housing comprises at least one clamp fastener and a clamping surface against which said at least one clamp fastener fastens said glue thickness adjuster, which clamping surface is oriented in a plane that is parallel or approximately parallel to a glue roller axis and intersects the peripheral surface of said glue roller.

8. The container labeling machine gluing apparatus according to claim 7, wherein the plane of said clamping surface intersects the peripheral surface of said glue roller at an angle of less than 90° which is open in the direction of rotation of said glue roller.

9. The container labeling machine gluing apparatus according to claim 8, wherein said at least one clamp fastener is configured to permit an adjustment and setting of said glue thickness adjuster relative to said glue roller and/or relative to said housing.

10. The container labeling machine gluing apparatus according to claim 9, wherein said spring element is fastened by said at least one clamp fastener.

11. The container labeling machine gluing apparatus according to claim 10, wherein said spring element comprises a spring plate having two opposing long sides, and wherein said glue contact element is fastened to one long side, and the other long side is fastened to said housing by said at least one clamp fastener.

12. The container labeling machine gluing apparatus according to claim 11, wherein said glue contact element is manufactured in one piece with said spring plate or is connected to said spring plate.

13. The container labeling machine gluing apparatus according to claim 12, wherein said spring plate is shaped on its long side supporting said glue contact element in the form of a comb with recesses and webs between said recesses.

14. The container labeling machine gluing apparatus according to claim 13, wherein said glue contact element is configured to be elastically deformable, and said spring plate is made of brass.

15. The container labeling machine gluing apparatus according to claim 1, wherein said glue roller is configured to move the glue layer of the desired thickness formed by said glue contact element immediately past said spring element.

16. A container labeling machine gluing apparatus comprising:

a rotatable glue roller being configured to apply glue to labels;

a glue scraper configured to scrape glue off of said glue roller;

a glue dispenser being configured to dispense glue onto said glue roller;

a glue thickness adjuster being disposed downstream of said glue dispenser and being configured to adjust thickness of a glue layer on said glue roller prior to application of glue to labels;

said glue thickness adjuster comprising a glue contact element configured to contact glue on said glue roller;

said glue thickness adjuster being adjustable to permit adjustment of the position of said glue contact element with respect to said glue roller;

said glue contact element being disposed upstream of remaining portions of its glue thickness adjuster in the direction of rotation of said glue roller, and said glue contact element points in the direction opposite the direction of rotation of said glue roller and away from remaining portions of said glue thickness adjuster;

said glue contact element comprising a first edge and a second edge; and said glue thickness adjuster being configured to be adjusted to move said glue contact element between at least a first position in which said first edge is disposed closer to said glue roller than said second edge and is in contact with glue on said glue roller to form a first layer of glue, and a second position in which said second edge is disposed closer to said glue roller than said first edge and is in contact with glue on said glue roller to form a second layer of glue which is thicker than said first layer.

17. The container labeling machine gluing apparatus according to claim 16, further comprising a glue scraper arrangement disposed upstream of said glue dispenser and downstream of said glue thickness adjuster.

18. The container labeling machine gluing apparatus according to claim 17, wherein:

said glue contact element is solely supported by said spring element;

said glue contact element is in the shape of a rail or bar and has a rectangular cross section; and said spring element comprises a leaf spring.

19. The container labeling machine gluing apparatus according to claim 18, wherein:

said housing comprises at least one clamp fastener and a clamping surface against which said at least one clamp fastener fastens said glue thickness adjuster, which clamping surface is oriented in a plane that is parallel or approximately parallel to a glue roller axis and intersects the peripheral surface of said glue roller;

the plane of said clamping surface intersects the peripheral surface of said glue roller at an angle of less than 90° which is open in the direction of rotation of said glue roller; and said at least one clamp fastener is configured to permit an adjustment and setting of said glue thickness adjuster relative to said glue roller and/or relative to said housing.

20. The container labeling machine gluing apparatus according to claim 19, wherein:

said spring element is fastened by said at least one clamp fastener;

said spring element comprises a spring plate having two opposing long sides, and wherein said glue contact element is fastened to one long side, and the other long side is fastened to said housing by said at least one clamp fastener; and at least one of (A), (B), (C), and (D):

(A) said glue contact element is manufactured in one piece with said spring plate or is connected to said spring plate;

(B) said spring plate is shaped on its long side supporting said glue contact element in the form of a comb with recesses and webs between said recesses;

(C) said glue contact element is configured to be elastically deformable; and (D) said spring plate is made of brass.

* * * * *